US007077140B1

(12) United States Patent
Berke

(10) Patent No.: US 7,077,140 B1
(45) **Date of Patent: *Jul. 18, 2006**

(54) FACE MASK AND METHOD

(76) Inventor: Joseph J. Berke, 3248 Interlaken, West Bloomfield, MI (US) 48323

( * ) Notice: Subject to any disclaimer, the term of this patent is extended or adjusted under 35 U.S.C. 154(b) by 0 days.

This patent is subject to a terminal disclaimer.

(21) Appl. No.: 10/850,908

(22) Filed: May 24, 2004

(51) Int. Cl.
*A62B 18/08* (2006.01)

(52) U.S. Cl. ..... 128/206.25; 128/206.24; 128/206.21; 128/206.12; 128/206.18; 128/207.27; 128/206.28; 128/207.13; 128/207.17; 128/200.24; 128/200.18; 128/206.14; 128/206.19; 606/161; 606/162; 606/199; 606/204.15; 606/204.45

(58) Field of Classification Search ..... 128/206.25, 128/206.24, 206.21, 206.12, 206.18, 207.27, 128/206.28, 207.13, 207.17, 200.24, 207.18, 128/206.14, 206.19; 606/161, 162, 199, 606/204.15, 204.45
See application file for complete search history.

(56) References Cited

U.S. PATENT DOCUMENTS 3,695,265 A * 10/1972 Brevik ..... 128/206.14
3,835,848 A * 9/1974 Berner ..... 606/204.45
5,243,708 A * 9/1993 Vanuch ..... 2/206
5,669,377 A * 9/1997 Fenn ..... 128/200.24
5,727,544 A * 3/1998 Miura ..... 128/201.13
5,976,173 A * 11/1999 Berke ..... 606/204.45
6,080,179 A * 6/2000 Gould ..... 606/204.45
6,092,521 A * 7/2000 Miura ..... 128/201.13
6,419,687 B1 * 7/2002 Berke ..... 606/204.45

* cited by examiner

*Primary Examiner*—Henry Bennett
*Assistant Examiner*—Nihir Patel
(74) *Attorney, Agent, or Firm*—Alex Rhodes

(57) ABSTRACT

A method for preventing a spread of diseases, promoting better breathing, improving comfort and reducing fatigue. The method utilizes a face mask and a noseform of the type disclosed in U.S. Pat. No. 5,976,173, which is incorporated herein by reference, In a first embodiment, the noseform is an integral part of a mask by forming, adhesion or heat bonding. In a second embodiment, the noseform is added to the mask prior to placing the mask in service with a usual method such as adhesion. In the first embodiment, the noseform is initially mounted on a person's nose by adhesively attaching the noseform to a lower portion of the nose, sliding the noseform upwardly toward the person's forehead and glabella and attaching an upper portion of the noseform to a fixed portion of the nose just below the glabella. The effect of this procedure is to shorten the person's airway and dilate the person's nasal passages. In the second embodiment, the noseform is initially mounted on a mask, followed by the steps of adhesively attaching the noseform to a lower portion of the nose, sliding the noseform upwardly toward the person's forehead and glabella and attaching an upper portion of the noseform to a fixed portion of the nose just below the glabella.

3 Claims, 3 Drawing Sheets

FACE MASK AND METHOD

FIELD OF THE INVENTION

This invention relates to face masks and respirators and, more particularly to a face mask or respirator with a noseform and a method to prevent inhaling and exhaling harmful air borne substances, to prevent a spreading of contagious air borne substances, to improve breathing and to prevent a fogging of eyeglasses.

BACKGROUND OF THE INVENTION

Face masks and respirators are worn by medical and industrial workers to prevent inhaling and exhaling harmful air borne substances, such as, paints, solvents, dust particles, toxic fumes, smoke, bacteria and fungal spores. They are also worn to prevent spread of colds and air borne infections by covering the nose and mouth. They include filter elements, such as cotton gauze, fiberglass and fibrous paper filters that allow air to pass freely but prevent undesirable substances from passing through and prevent the spread of harmful bacteria at locations such as operating rooms. They also prevent individuals with diseases from infecting others.

Many include a thin metal band, which is shaped by a user to conform to the shape of the user's face. U.S. Pat. Nos. 2,578,007, 2,752,916, 3,220,409, 3,971,369, 4,796,621, 5,803,075, and 5,561,863 are exemplary of respirators and masks in the prior art.

One shortcoming of current respirators and face masks is that they restrict the flow of air through mouths and noses because of inhaling and the pressure of respirators and masks against the mouth and nose. This can cause respiratory discomfort, particularly in persons with medical conditions such as asthma, heart and lung ailments as well as healthy individuals under stress, in elevated temperatures and congested conditions, especially during prolonged surgery in operating rooms.

Nasal dilators have been developed to prevent nasal passages from contracting because the alae of the nose draw in during breathing, thereby reducing the amount of air entering a nose. The principle of these dilators is to attach resilient members at the sides of noses, which tend to open and spread nose tissues. By way of example, flat resilient bands are used which take on arcuate shapes when adhesively applied to sides of noses, thereby tending to restore themselves to initial shapes and preventing narrowing of nares. Although these dilators are intended to prevent nasal passage contractions, they are not intended to open nasal passages beyond their normal conditions. U.S. Pat. No. 5,803,075 and U.S. Pat. No. 6,336,456 show masks with nasal dilators that pull on soft tissue at the sides of a nose to prevent the alae from contracting while inhaling.

In my U.S. Pat. No. 5,976,173, which is incorporated herein by reference, a noseform is disclosed which shortens and opens an airway by sliding the dorsal and lateral nasal skin upward to shorten and open nasal passages. The noseform of my U.S. Pat. No. 5,976,173 uses an entirely different principle than any other dilators.

SUMMARY OF THE INVENTION

The primary object of the present invention is to promote a more comfortable and efficient air exchange in face masks and respirators by incorporating noseforms of the type disclosed in my U.S. Pat. No. 5,976,173. The noseform can be supplied as part of a mask or respirator or attached to a mask or respirator by a person with a usual method of joining, such as adhesion, heat bonding or sewing. One of the benefits of the invention is that the combined mask and noseform is effective with healthy as well as physically impaired persons suffering ailments such as nasal obstructions, asthma, and impaired heart and lungs. Another benefit is that it improves the comfort and reduces the fatigue of surgeons, nurses, and other medical persons in operating rooms. It also prevents fogging of glasses and it is relatively low in cost.

In employing the teaching of the present invention, a plurality of alternate constructions can be provided to achieve the desired results and capabilities. In this disclosure, some alternate constructions are discussed. However, these embodiments are intended as examples, and should not be considered as limiting the scope of my invention.

Further objects, benefits and characterizing features of the invention will become apparent from the ensuing detailed description and drawings which illustrate and describe the invention. The best mode which is contemplated in practicing the invention together with the manner of using the invention are disclosed and the property in which exclusive rights are claimed is set forth in each of a series of numbered claims at the conclusion of the detailed description.

BRIEF DESCRIPTION OF THE DRAWINGS

The invention will be better understood and further objects, characterizing features, details and advantages thereof will appear more clearly with reference to the diagrammatic drawings illustrating a presently preferred specific embodiment of the invention by way of non-limiting example only.

DETAILED DESCRIPTION OF A PREFERRED EMBODIMENT

Figure 1:
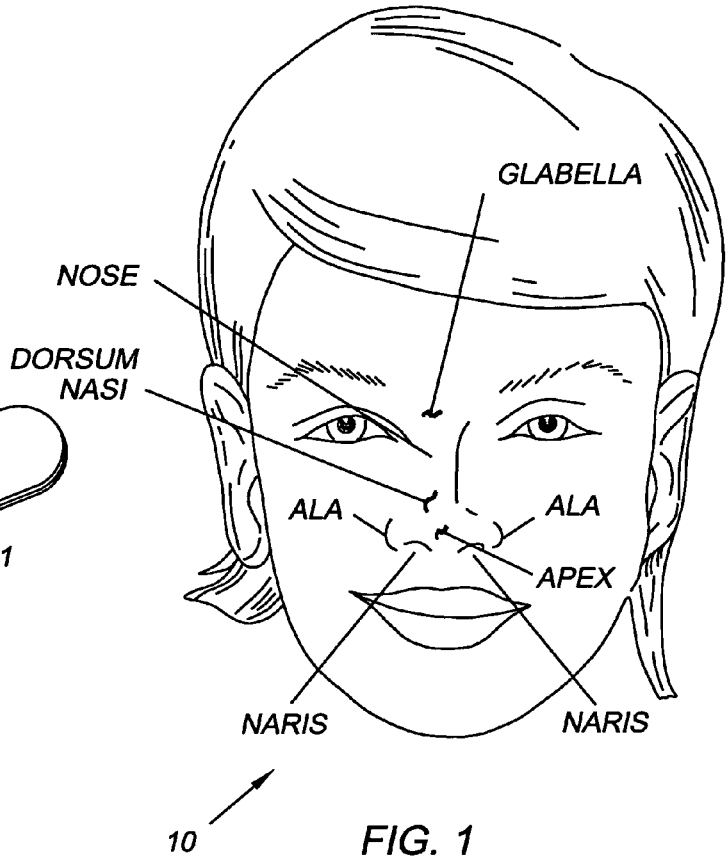
FIG. 1 is a front view of a human face with identified facial features, which are relevant to the present invention.

Referring now to the drawings wherein like numerals designate like and corresponding parts throughout the several views, in FIG. 1 a human face 10 is shown with designated features which are relevant to the present invention. A nose is covered with skin, which is movable in certain directions. The skin is movable along certain lines, referred to as Langers lines (not shown), which identify how the skin is movable. The lines along the nose run approximately transverse to the direction of the nose at approximately the center of the face. Thus, the skin of the nose is most easily moved from the nasal apex essentially vertically along the direction of the nose (this applies to the skin above the dorsal nose).

Figure 2:
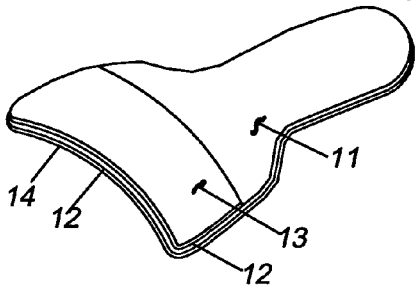
FIG. 2 is a perspective view of a noseform.

In FIG. 2 a noseform 11 is shown according to my U.S. Pat. No. 5,976,173 which is incorporated herein by reference. The noseform 11 is preferably made of a relatively thin, flexible elastic material. The noseform 11 has an adhesive coating 12 on an outer surface for adhering the noseform 11 to the nose and an adhesive coating 12 on an opposite inside surface for adhering the noseform 11 to a respirator or mask. The noseform material is preferably non-allergenic, capable of conforming to differently shaped noses and porous to allow the skin to breathe and perspiration to evaporate. Thin flexible peelable covers 13, 14 overlying the adhesive coatings 12 are removed when the noseform 11 is placed in service.

Figure 6:
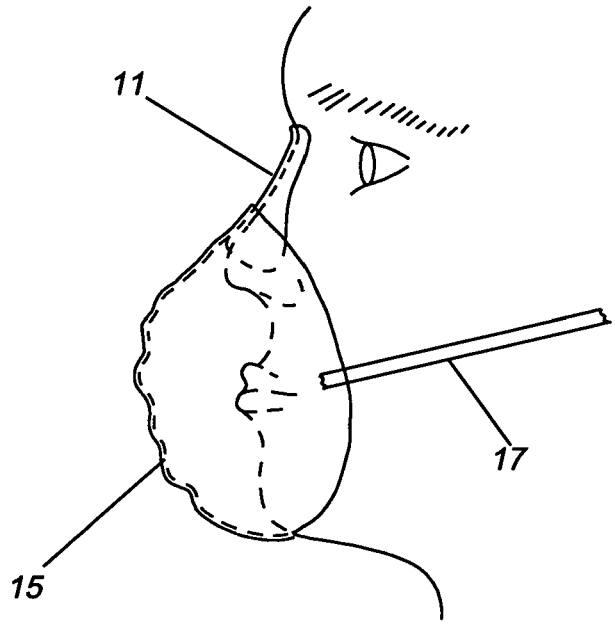
FIG. 6 is a side view of a human face with a mask and the noseform according to the invention.

With reference to FIG. 6, the noseform 11 is shown in combination with a face mask 15. The face mask 15 is conventional and is comprised of a flexible covering member 16, made of a porous material such as cloth, fiberglass or a cellulose fiber and a strap 17 for attaching the mask 15 to a person. A similar face mask is shown in U.S. Pat. No. 3,220,409. Several embodiments are contemplated for this combination. One embodiment is an integration of the noseform 11 on an upper portion of the mask 15 by a usual method such as one-piece forming, sewing, adhesion or heat bonding.

Figure 3:
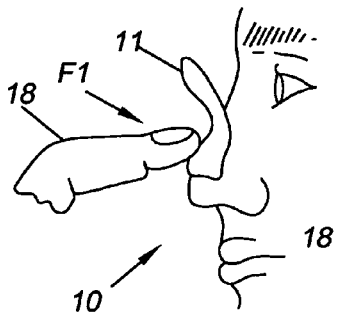
FIG. 3 is a side view of the noseform showing the application of the noseform to a human nose.
Figure 7:
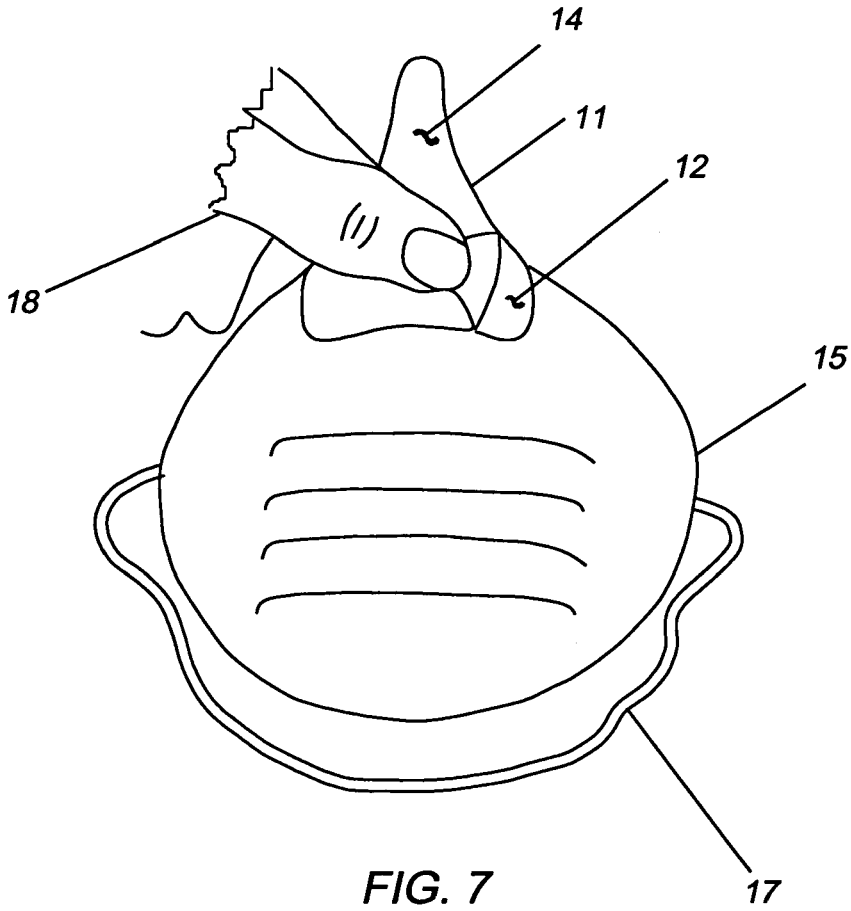
FIG. 7 is a rear view of the mask and the noseform showing a peelable layer being removed from an adhesively coated surface.

A second embodiment is an assembly by a person with the adhesive 12 or Velcro® (not shown) on the outer surface of the noseform 11 to an upper portion of the front or rear surface of the mask 15 before the mask is mounted on the person. A third embodiment which is similar to the second embodiment is an assembly by a person with the adhesive 12 or Velcro®) (not shown) on the outer surface of the noseform 11 to an upper portion of the front or rear surface of the mask 15 after the noseform 11 is first mounted on the person. In each of the above embodiments as shown in FIG. 3, the lower portion of the noseform is adhesively attached and conformed to a lower portion of the nose by removing the peelable layer on the inner surface of the noseform as shown in FIG. 7, and pressing the lower portion of the noseform across the dorsum nasi in a direction "F" with the person's fingers 18.

Figure 4:
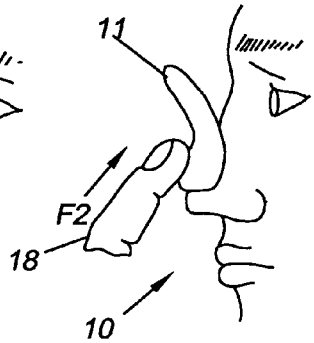
FIG. 4 is a side view of the noseform showing the application of the noseform to a human nose at a later step than FIG. 3.
Figure 5:
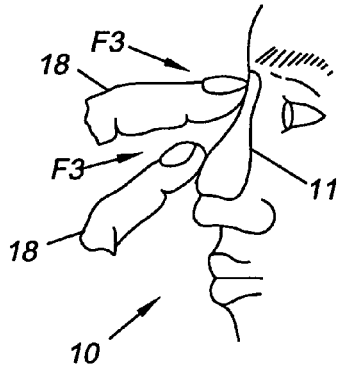
FIG. 5 is a side view of the noseform showing the application of the noseform to a human nose at a later step than FIG. 4.
Figure 8:
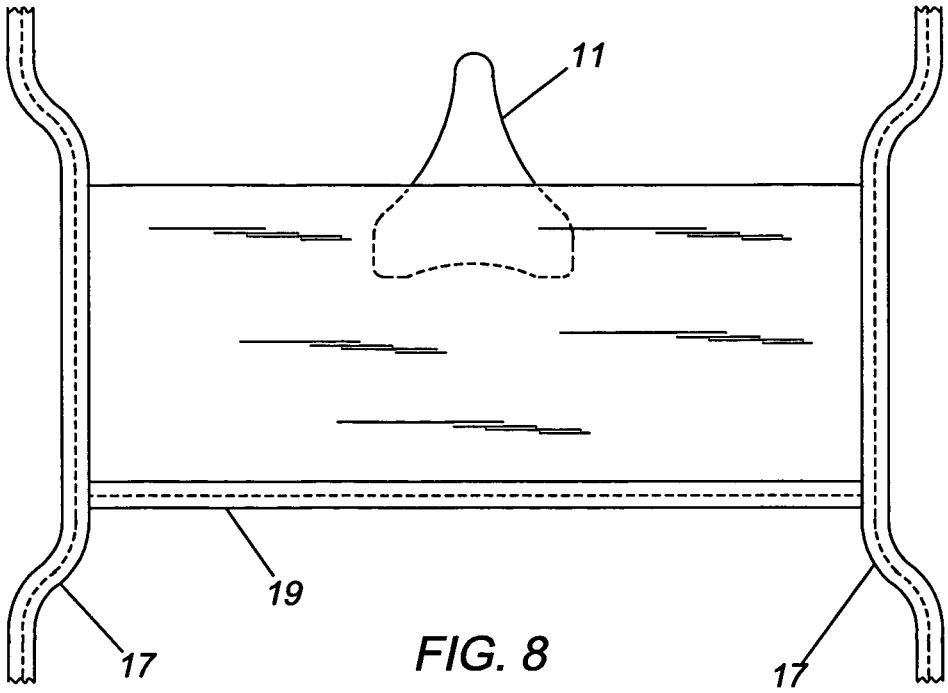
FIG. 8 is a front view of a surgical mask and the noseform according to the present invention.
Figure 9:
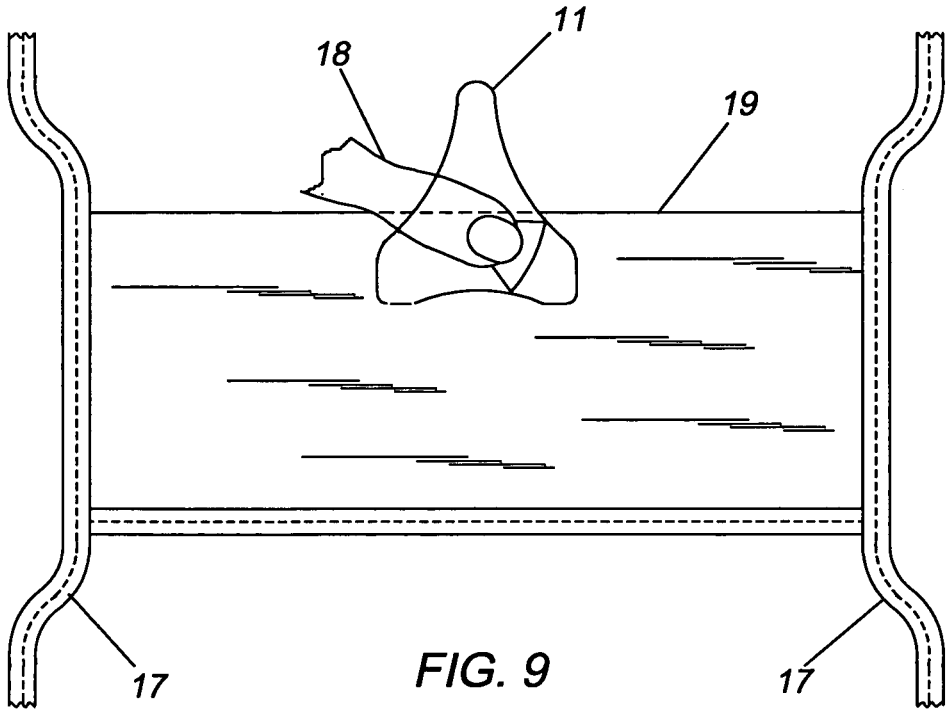
FIG. 9 is a rear view of the surgical mask and the noseform.

Referring to FIG. 4, the dorsal and lateral skin portions of the nose are next slid upwardly toward the forehead and glabella in a direction "F2" causing a shortening of the nasal passages and a dilation of the nasal passages and nares. As a final step, as shown in FIG. 5, an upper portion of the noseform 11 is pressed in a direction "F3" to adhesively attach the upper portion of the noseform to a fixed portion of the nose, just below the glabella to maintain the elevated positions of the dorsal and lateral skin portions and prevent the alae of the nose from closing and narrowing the nasal passages. This improvement is augmented by the tendency of the lower end portion of the noseform 11 to restore to its original open shape. The efficacy of my invention has been demonstrated with tests of the invention. Other embodiments of my noseform 11, which are contemplated for use with a respirator or mask, are disclosed In my U.S. Pat. No. 5,976,173 . incorporated herein by reference. In FIGS. 8 and 9, a surgical mask 19 is shown in combination with my noseform 11 to exemplify that my invention is not limited to the mask which is depicted in FIGS. 1–7.

While my invention has been described in terms of a preferred and alternate embodiment, it should be apparent that after having the benefit of my disclosure other embodiments can be constructed by a person skilled in the art with obvious changes such as changes in shape, substitutions of materials, inversions of elements, and substitutions and deletions of elements without departing from the spirit thereof.

What I claim is new:

1. A method for promoting improved breathing efficiency, improving comfort and reducing fatigue while maintaining a normal function of a face mask, said method comprising the steps of: removing a thin flexible cover overlying an adhesive coating on an outer surface of a thin flexible noseform which is mounted on said mask; adhesively attaching a lower portion of said thin flexible noseform to a lower portion of a person's nose, sliding the skin of the dorsum nasi of said person toward said person's forehead and glabella to shorten said person's airway and dilate said person's nasal passages and adhesively attaching an upper portion of said noseform to a fixed portion of said person's nose just below said glabella.

2. The method recited in claim 1 further comprising the step of removing a thin flexible cover overlying an adhesive coating on an outer surface of said noseform before attaching said noseform to said face mask.

3. A method for promoting improved breathing efficiency, improving comfort and reducing fatigue while maintaining a normal function of a face mask, said method comprising the steps of: removing a thin flexible material from an outer surface of a thin flexible noseform to expose an adhesive coating on said outer surface of said noseform; attaching said noseform to said face mask with said adhesive layer; removing a peelable layer of a thin flexible material from an inner surface of a thin flexible noseform to expose an adhesive coating on said inner surface of said noseform, pressing a lower portion of said noseform against a lower portion of a person's nose to conform and adhesively attach said lower portion of said noseform to said lower portion of said person's nose, sliding dorsal and lateral skin portions of said nose upwardly toward said person's forehead and glabella to cause a shortening of said person's airway and to dilate said person's nasal passages; and pressing an upper portion of said noseform against a fixed portion of said nose, just below said glabella to maintain the elevated positions of said dorsal and lateral skin portions and prevent a narrowing of said nasal passages.

* * * * *